United States Patent [19]

Cherry et al.

[11] Patent Number: 4,849,674

[45] Date of Patent: Jul. 18, 1989

[54] ELECTROLUMINESCENT DISPLAY WITH INTERLAYER FOR IMPROVED FORMING

[75] Inventors: Walter L. Cherry, Waukegan, Ill.; David Glaser, El Paso, Tex.

[73] Assignee: The Cherry Corporation, Waukegan, Ill.

[21] Appl. No.: 24,982

[22] Filed: Mar. 12, 1987

[51] Int. Cl.[4] ..... H05B 33/22

[52] U.S. Cl. ..... 313/509; 313/503; 445/6

[58] Field of Search ..... 313/500, 503, 505, 506, 313/509, 11, 15, 17; 445/6

[56] References Cited

U.S. PATENT DOCUMENTS

| | | | |
|---|---|---|---|
| 3,048,731 | 8/1962 | Lehmann | 313/509 |
| 3,731,353 | 5/1973 | Vecht | 29/25.13 |
| 3,854,070 | 10/1974 | Vlasenko et al. | 313/503 |
| 4,140,937 | 2/1979 | Vecht et al. | 313/503 |
| 4,418,118 | 11/1983 | Lindfors | 313/503 X |

FOREIGN PATENT DOCUMENTS

| | | | |
|---|---|---|---|
| 0140246 | 5/1985 | European Pat. Off. | 33/22 |
| 0141116 | 5/1985 | European Pat. Off. | 33/22 |
| 1474251 | 5/1977 | United Kingdom | 11/42 |
| 1594356 | 7/1981 | United Kingdom | 33/20 |
| 1600545 | 10/1981 | United Kingdom | 33/12 |
| 1602895 | 11/1981 | United Kingdom | 33/22 |
| 2095470 | 9/1982 | United Kingdom | 33/02 |
| 2106317 | 7/1983 | United Kingdom | 33/22 |

OTHER PUBLICATIONS

Tannas, Jr., *Electroluminescent Displays*, Ch. 8, pp. 237–288, 1/1984.

*Primary Examiner*—Kenneth Wieder

*Attorney, Agent, or Firm*—Willian Brinks Olds Hofer Gilson & Lione Ltd.

[57] ABSTRACT

An electroluminescent D.C. display panel has a transparent substrate, transparent anodes, a metal oxide interlayer, an electroluminescent powder phosphor, and cathodes formed in stacked relation on the substrate. The metal oxide interlayer allows the panel to be formed relatively quickly at substantially reduced forming currents.

35 Claims, 1 Drawing Sheet

ELECTROLUMINESCENT DISPLAY WITH INTERLAYER FOR IMPROVED FORMING

TECHNICAL FIELD

This invention relates to an improved structure and method of manufacturing for an electroluminescent display. More particularly, it relates to the use of a transparent metal oxide interlayer that facilitates electrical forming of the phosphor of a D.C. matrix display panel or a segmented D.C. display panel.

BACKGROUND OF THE INVENTION

Electroluminescence is the emission of light from a crystalline phosphor due to the application of an electric field. A commonly used phosphor material is zinc sulfide activated by the introduction of less than one mole percent of various elements such as manganese into its lattice structure. When such a material is subjected to the influence of an electric field of a sufficient magnitude, it emits light of a color which is characteristic of the composition of the phosphor. Zinc sulfide activated with manganese (referred to as a zinc sulfide:-manganese or ZnS:Mn phosphor) produces a pleasant yellowish orange centered at 585 nanometers (nm) wavelength.

ZnS:Mn phosphors are characterized by high luminance, luminous efficiency and discrimination ratio, and long useful life. Luminance is brightness or luminous intensity when activated by an electric field, and is commonly measured in lamberts, i.e. candelas per pi square centimeters, or in foot-lamberts, i.e. candelas per pi square feet. Luminous efficiency is light produced compared to power consumed by the device, commonly measured in lumens per watt. Discrimination ratio is the ratio of luminance in response to an "on" voltage to luminance in response to an "off" voltage.

A wide range of colors can be obtained by substituting or supplementing the manganese with other materials such as copper or alkaline earth activators, or by substituting or supplementing the zinc sulfide with other similar phosphorescent materials such as zinc selenide.

Phosphor materials can be formulated into a wide variety of electroluminescent configurations to serve numerous functions. In many electroluminescent devices the electroluminescent display is a panel which is divided into a matrix of individually activated pixels (picture elements).

Two major subdivisions of electroluminescent devices are defined in terms of the intended alternating current (AC) or direct current (DC) operating modes. In DC configurations, electrons from an external circuit pass through the pixels in the panel. In AC configurations, the pixels are capacitively coupled to an external circuit.

Electroluminescent devices are also made using either powder or thin-film phosphor configurations. Powder phosphors are formed by precipitating powder phosphor crystals of the proper grain size, suspending the powder in a lacquer-like vehicle, and then applying the suspension to a substrate, for example by spraying, screening or doctor-blading techniques. Thin-film phosphors are grown from condensation of evaporants from vacuum vapor depositions, sputtering, or chemical vapor depositions.

Two configurations to which the present invention has high applicability are the powder phosphor electroluminescent matrix and segmented display panels, intended for operation in the direct current (DC) mode. Matrix display panels can be used for a variety of applications, and in general, can find utility as substitutes for cathode ray tubes (CRTs), wherever CRTs are used. For example, matrix display panels can be used for such applications as oscilloscopes, television sets and monitors for computers. A particularly advantageous application for the matrix display panel is as the monitor for a microcomputer, or personal computer. By avoiding the need for a CRT, an electroluminescent matrix display panel can make a personal computer more compact and thus more easily portable.

Segmented display panels find utility for example as alphanumeric displays in such apparatus as digital clocks; pocket calculators; and gasoline pump indicators.

In manufacturing DC electroluminescent displays, it is necessary to electrically stimulate the phosphor of the display in a process that is known as "forming." The electrical process of forming is required to provide a continuous film in the phosphor that will luminesce with maximum intensity at a particular desired operational voltage. This forming process has been used with powder phosphor electroluminescent panels manufactured in accordance with the processes described in the following commonly owned patent applications:

| Ser. No. | Inventor(s) | Title | Filing Date |
|---|---|---|---|
| 752,317 | Glaser | Phosphorescent Material For Electroluminescent Display | 7/3/85 |
| 849,768 | Glaser | Phosphorescent Material For Electroluminescent Display, Having Decreased Tendency For Further Forming | 4/9/86 |

In manufacturing, it has been found necessary to form electroluminescent display panels in a twostage process. In the first stage, the panel is formed from its virgin state to provide luminescence at a voltage of about 25 volts. This first stage is known as initial forming of the panel. In the second stage, the voltage applied to the panel is increased until luminescence is provided at a desired activating voltage of, for example, 70 volts. This second stage of the process is known as final forming.

In the forming process, a voltage is placed across anode and cathode conducting electrodes disposed in stacked relation on an underlying glass substrate. When the voltage is applied to these electrodes, a current flows through the electroluminescent powder phosphor that is disposed between the electrodes. The level of voltage and current determines the speed with which the phosphor of the panel is formed from its virgin powder phosphor state to the desired state wherein a luminous film is provided to radiate light at a defined final voltage.

It is known that a substantial current is required during the initial forming stage to achieve luminescence and forming of the panel. However, the current that flows through the phosphor has the undesirable effect of excessively heating the phosphor during the forming process. Excessive heat will cause the phosphor to degrade, and will therefore result in reduced illumination and light for the panel that is finally formed. Accordingly, it has been found necessary to limit the amount of current that flows in the panel during the initial forming process to about 150 milliamps/cm$^2$ at a voltage that is gradually increased from about 12 volts to 25 volts. During the initial forming process, the voltage and current must be very carefully controlled to limit the power applied to the panel and the resultant heating of the phosphor.

Also, if it is desired to initially form a rather large electroluminescent matrix display having, for example, 640 columns and 200 rows, it has not heretofore been possible to form all of the pixels or phosphor elements of the panel at one time. Simultaneous forming of all pixels of such a panel results in excessive heating and degradation of the phosphor. Accordingly, it has been found necessary to cycle the energization of spaced pixels or lines of pixels of the panel during the initial forming process. Thus, for example, it has been found that a matrix display panel may be initially formed by energizing for a particular time an initial set of column or row electrodes spaced about 16 electrodes apart. Thereafter, another set of electrodes is energized to allow the previous set to cool. Spaced sets of electrodes of the panel are cycled in this fashion for about 90 minutes until the panel has been initially formed to about 25 volts. Thereafter, in the final forming process, phosphor resistance is increased and voltage in excess of 25 volts is applied to the entire panel and increased to the final formed voltage. Thus, in the final forming process, the entire panel is energized and is brought relatively quickly to the desired final energization voltage for the panel.

A special electrical fixture and energization control circuitry are required to initially cycle forming voltage to the panel in a manner that provides about 150 milliamps/cm$^2$ of current for the phosphor. Even with careful control of the applied power, some degradation of the phosphor is likely and the panel is therefore not formed in an optimum manner. Also, the sensitive control of the power during the initial forming process results in panels that have nonuniform life and luminescence characteristics.

It has been suggested by others that the initial forming process can be facilitated by disposing a layer of nitrocellulose between the conducting anodes and phosphor of the display. It has been found that this insulating interlayer of nitrocellulose decreases the amount of current required to initially form the panel by about fifty percent. However, the forming current is still sufficiently high so that rows and columns of a matrix panel must still be energized cyclically to form the panel. Accordingly, although excessive heating and degradation of the panel may be reduced, the initial forming process still requires considerable time.

Moreover, it has been found that nitrocellulose will tend to degrade and form water when it is heated in the forming process. It has been found that water within the panel contributes to degradation and undesirable further forming of the phosphor beyond the final formed voltage. This degradation and further forming of the panel results in a substantially decreased life for the panel.

Also, the organic nitrocellulose interlayer is applied to the panel by a relatively imprecise dipping process that produces an interlayer of nonuniform thickness. Also, the interlayer has a tendency to form pinholes. The pinholes result in microchannels of relatively intense current during forming and thereby contribute to undesirable heating of the panel. Finally, the dipping process must be carried out in a relatively dust-free environment. Accordingly, dipping requires a rather expensive clean room facility.

The disadvantages of the use of a nitrocellulose interlayer are so substantial that this interlayer is generally not favored in a high volume manufacturing process. Accordingly, even though it provides a desirable reduction in the amount of current for initial forming, its disadvantages discourage its use in manufacture.

Also, it has been found that a conducting sulfur nitride polymer ($SN_x$) can form in the phosphor of a display and adversely affect the operation of the phosphor. It would be desirable to avoid the formation of this polymer and also convert any $SN_x$ polymer that is formed to a harmless substance within the phosphor.

It is therefore an object of the invention to provide an electroluminescent display panel that can be initially formed in a relatively short time and with little or no degradation of the phosphor.

It is another object of the invention to provide such a panel that is initially formed as a whole.

A further object of the invention is to provide an electroluminescent panel with a transparent inorganic insulative interlayer that is precisely formed as a thin film between the conducting anodes and phosphor of an electroluminescent panel.

Another object of the invention is to provide a panel with a metal oxide interlayer that will facilitate initial forming.

A further object of the invention is to provide an electroluminescent panel with an interlayer that is made of either aluminum oxide, magnesium fluoride, magnesium oxide, yttrium oxide, or zinc sulfide.

Another object of the invention is to provide an improved process for avoiding the formation of a sulfur nitride polymer in the phosphor and converting any of this polymer that is formed to harmless $S_2N_2$.

SUMMARY OF THE INVENTION

In order to achieve the objects of the invention and to overcome the problems of the prior art, the electroluminescent display panel of the invention has conducting anode and cathode electrodes, an electroluminescent phosphor disposed in contact with the cathode, and an inorganic insulating interlayer, for example aluminum oxide, disposed between and in contact with the anodes and the electroluminescent phosphor. In an initial forming process, the inorganic interlayer substantially reduces the current required for forming and concentrates necessary heating at the interface between the interlayer and the phosphor. The entire panel is therefore quickly formed at one time. The interlayer is precisely applied to the panel by vapor deposition or sputtering. The thin film interlayer has a uniform thickness of from 50 to 150 angstroms, and preferably 100 angstroms.

In the manufacturing process, the phosphor of the panel is flushed with inert or noble gas such as argon or helium to remove nitrogen and thereby avoid the formation of an undesirable $SN_x$ polymer in the phosphor. Also, silver is added to the phosphor so that any $SN_x$ that is formed is converted to harmless $S_2N_2$ in the presence of heat or electrical energy.

DETAILED DESCRIPTION

Figure 1:
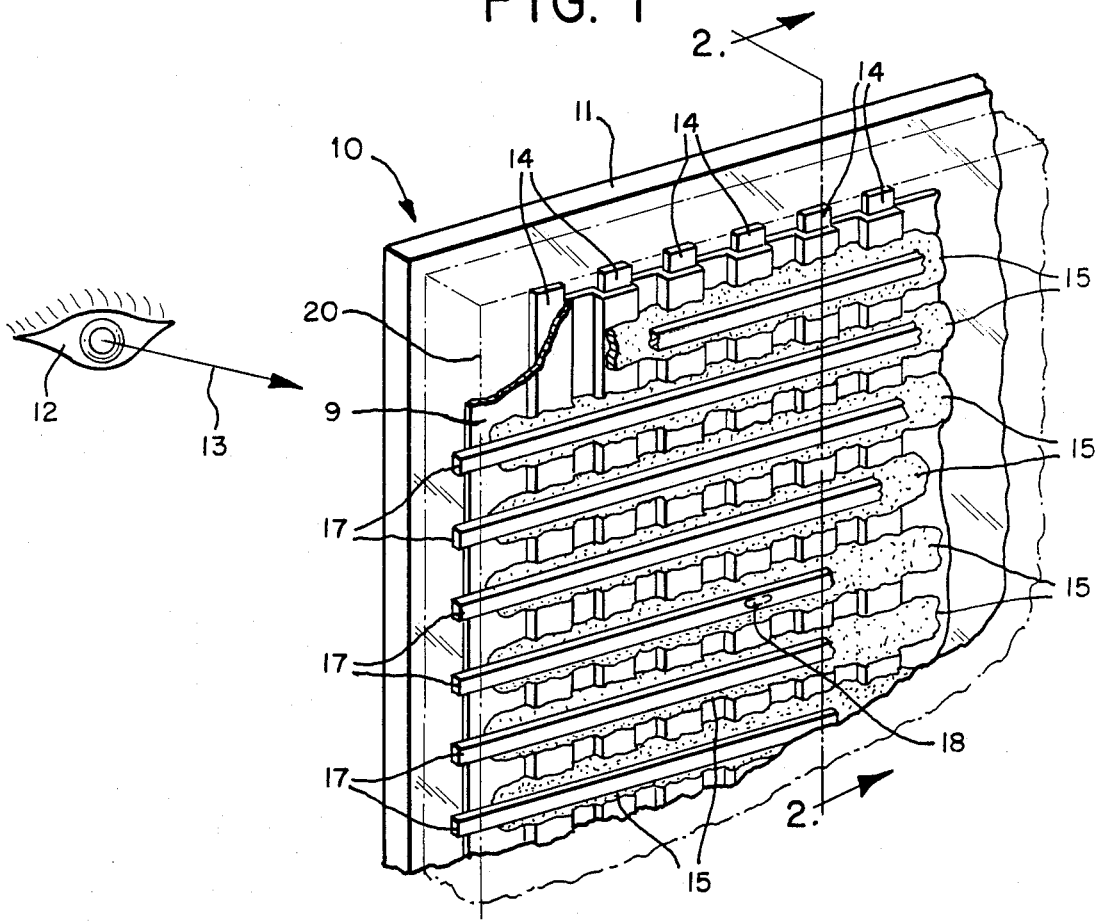
FIG. 1 is a schematic representation, in perspective, of a portion of an electroluminescent matrix display panel according to the invention.
Figure 2:
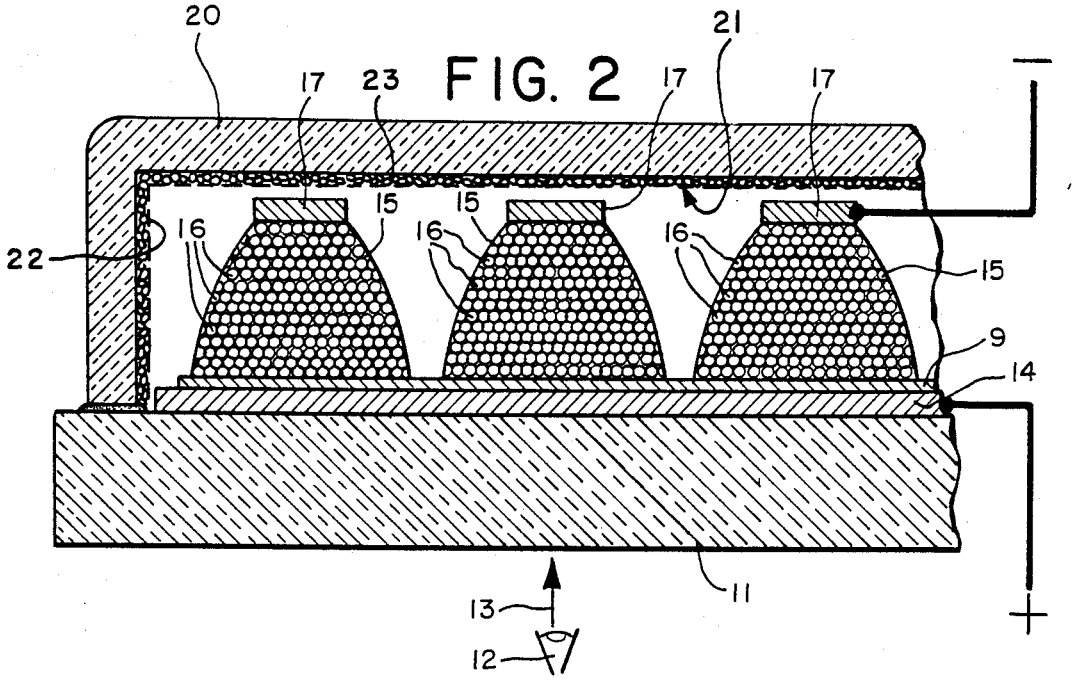
FIG. 2 is an expanded cross-sectional view of the electroluminescent matrix display panel of FIG. 1, illustrating detail of its construction, and taken along line 2—2 of FIG. 1.

FIG. 1 illustrates a schematic representation of the back of an electroluminescent matrix display panel 10. A cross-section of a portion of the panel is shown in FIG. 2, taken along line 2—2 of FIG. 1. The elements of FIGS. 1 and 2 have not been drawn to scale, in order to facilitate an understanding of the invention.

The panel 10 has a transparent substrate 11 upon which are deposited, on one side, various layers hereinafter described. These layers produce electroluminescence that is viewed by an observer 12 through the transparent substrate 11 along a line of sight 13.

The general structure and operation of electroluminescent matrix display panels are known; see, for example, E. L. Tannas, *Electroluminescent Displays,* chapter 8 in E. L. Tannas, Ed., *Flat-Panel Displays and CRTs* (1984); Vecht, U.S. Pat. No. 3,731,353; Kirton et al., U.S. Pat. No. 3,869,646; and Vecht et al., U.S. Pat. No. 4,140,937. The following explanation, however, will allow an understanding of the invention without reference to the prior art.

As shown in FIGS. 1 and 2, the substrate 11 is transparent, flat and electrically nonconductive. The preferred materials for the substrate 11 are glasses such as soda-lime glass and borosilicate glass. Typically, the substrate is about 0.110 inches (0.2794 cm) thick.

A plurality of mutually parallel transparent electrically conductive anodes 14 are formed on one side of the substrate 11 with a light transmittance of 80% and a resistivity of 5 ohms per square. The anodes 14 can be made of doped tin oxide or indium-tin oxide.

A uniform layer 9 of a transparent insulating material, preferably aluminum oxide, is formed over the electrodes 14 at a thickness of from 50 to 150 angstroms, or preferably 100 angstroms. The interlayer 9 completely covers the face of the substrate and anodes 14. However, the interlayer is cut away in FIG. 1 to expose end portions of the anodes to facilitate an understanding of the structure of the panel. Although the preferred material of this interlayer is aluminum oxide, other transparent insulators such as magnesium oxide, magnesium fluoride, yttrium oxide, or zinc sulfide could be used.

Mutually parallel phosphor rows 15 are formed over the interlayer 9. The rows are from 15 to 40 microns thick and are preferably about 25 microns thick. The rows are arranged in perpendicular relation to the anodes 14.

The phosphor rows 15 are made of a dielectric binder and suspended phosphor particles 16 (see FIG. 2) having a size of from about 0.1 to about 2.5 microns. The phosphor particles 16 are made of zinc sulfide containing from about 0.1 to about 1.0%, preferably about 0.4%, by weight manganese; preferably also about 0.05% by weight copper; and a coating of copper sulfide on the phosphor particles.

Silver is provided in the coating of copper sulfide on the phosphor particles 16, in an amount from about 2 to about 12%, preferably from about 5 to about 10%, and more preferably about 8%, by weight of copper in the coating of copper sulfide on the phosphor particles.

The dielectric binder is, according to one preference, an organic material such as nitrocellulose. However, an inorganic binder such as tin sulfide or a ceramic material could also be used. The organic binder has 0.1 to about 3% and preferably about 0.2% of elemental sulfur, by weight of the phosphor particles.

A plurality of mutually parallel electrically conductive cathodes 17, preferably of aluminum, are disposed on associated phosphor rows 15. By indicating the placement of the anodes 14, interlayer 9, phosphor rows 15 and cathodes 17, it is intended to specify the configuration ultimately provided for the electroluminescent display, and not necessarily the order in which these elements are formed in display. In the manufacturing process, it is convenient to apply phosphor particles and binder in a layer and aluminum for the cathodes 17 in another layer, and then to scribe both simultaneously to form phosphor rows 15 and cathodes 17. As is known in the art, there are also other methods of simultaneously forming phosphor rows and electrodes, which can also be used.

In manufacturing and use, current flows between cathodes 17 and anodes 14, first to render sections of the phosphor rows 15 into a matrix of electroluminescent points, and later to cause these points to luminesce. Energized current will flow in the most direct path between the cathodes 17 and anodes 14. This current flows through the portions of the phosphor rows 15 disposed at the crossover points of anodes and cathodes. Each such portion of the phosphor rows 15 is a pixel 18. Each pixel 18 is caused to luminesce independently, by circuitry (not shown) that energizes combinations of cathodes 17 and anodes 14 to form an image.

The anode columns 14 of the electroluminescent panel are preferably spaced about 0.25 millimeter apart and the cathode rows 17 have the same spacing. The anodes and cathodes form a matrix with a density of about 16 pixels per square millimeter, or 1600 pixels per square centimeter. FIG. 1 shows a portion of such a panel having a matrix formed by 640 columns and 200 rows and dimensions of 10.5 inches (26.67 cm) wide and 4.5 inches (11.43 cm) high.

As shown in FIG. 2, the anodes 14, cathodes 17, phosphor rows 15 and interlayer 9 are sealed by a back cap 20 against the substrate 11 in a vacuum or an atmosphere of an inert or noble gas such as argon or helium. The cap 20 may be made of aluminum or glass. The cap has a 13× molecular sieve 21 that is disposed over its inside surface. The sieve is made up of a perforated metal screen 22 and alumino silicate beads 23 that are trapped between the screen and the inside surface of the cap 20. The sieve 21 is freshly degassed before being disposed in the cap 20.

The cap 20 is sealed to the substrate by a low permeation adhesive, such as a low outgassing epoxy resin, i.e., a resin which does not generate significant amounts of gas during its curing. A suitable adhesive is Bacon FA-1 epoxy resin adhesive, an unfilled gyrograde adhesive sold by Bacon Industries, Inc. of Watertown, Mass. and Irvine, Calif.

In manufacturing the electroluminescent display, the parallel, transparent, electrically conductive anodes 14 are formed on the substrate 11 by a vapor deposition process wherein a chamber containing the substrate is evacuated and doped tin oxide or indium-tin oxide are formed on the glass in a known manner. In a preferred embodiment, doped tin oxide is deposited in a film sufficiently thin to provide a light transmittance of 80% and a resistivity of 5 ohms per square. Thereafter, the interlayer 9 is formed over the anodes 14 by evaporating 50 to 150 angstroms, and preferably 100 angstroms of metallic aluminum onto the substrate 11 and anodes.

The metallic aluminum is evaporated onto the substrate in a manner known to the art by a vacuum metalizing machine. In operation, substrates with anodes formed thereon are washed with a mild detergent and deionized water, rinsed with deionized water and rinsed again with isopropyl alcohol. The cleaned substrates are then placed about the periphery of a rotatable carousel (not shown) which is disposed in a vacuum chamber (not shown). A vacuum of $10^{-5}$ torr or greater is then applied within the chamber and the carousel is rotated while aluminum is evaporated. The rate of rotation is such that one rotation of the carousel is sufficient to deposit a dense, pinhole free 100 angstrom film of aluminum on the substrate 11 and over the anodes 14. The aluminum film is then baked at about 450°-500° C. in air to change the aluminum film to aluminum oxide.

It should generally be understood that the invention is not limited to using aluminum oxide as an interlayer. Other transparent, insulating materials such as magnesium oxide, magnesium fluoride, yttrium oxide or zinc sulfide could be used. Moreover, the invention is not limited to a particular process or method for forming the interlayer on the substrate 11. Any known process such as vapor deposition or sputtering may be used to form the interlayer, so long as the process results in a pinhole free interlayer that is transparent to visible light and has a uniform thickness. The interlayer should also have a breakdown voltage in the range of 6 to 15 volts, and preferably about 10 volts. Also, an interlayer could be applied directly to the substrate, for example in the form of a metal oxide by sputtering, and thereby avoid the process step of baking in air.

A homogeneous powder of zinc sulfide crystals is prepared independently of the process for depositing the anodes and interlayer. The powder contains from about 0.1 to about 1.0%, preferably about 0.4%, by weight manganese, and preferably also about 0.05% by weight copper. The crystal grains have a size between 0.1 and 2.5 microns. In operation, an aqueous solution of salts is initially prepared. The solution contains a common anion and the desired proportions of cations, such as zinc acetate containing 0.4% manganese acetate and 0.05% copper acetate. A precipitating agent such as thioacetamide is added to the solution to precipitate a powder of zinc sulfide, manganese sulfide and copper sulfide in the desired proportions. The precipitate is then washed in acetic acid and deionized water, fired in an inert atmosphere in a silica crucible at 960° C. to recrystallize the zinc sulfide and is washed, dried and sieved.

The crystal gains are then immersed and suspended in an aqueous salt solution preferably containing for each gram of phosphor particles, 5 to 10 ml of deionized water, 1 ml of 0.1 molar copper nitrate and 0.05 ml of 0.1 molar silver nitrate. The solution is agitated with a mixer to effect a surface replacement of zinc with copper and yield zinc sulfide manganese particles coated with copper sulfide. The silver nitrate provides silver in the coating of copper sulfide on the phosphor particles, in an amount of from about 2 to about 12% preferably from 5 to about 10%, and more preferably about 8%, by weight of copper in the coating of copper sulfide on the phosphor particles. The coated zinc sulfide manganese particles are then filtered from the solution, rinsed with deionized water and dried.

A dielectric binder solution is prepared by mixing a nitrocellulose lacquer and a thinner provided by the Hercules Powder Company. In general, it should be understood that other thinners could be used, if they are made from toluene, xylene, isopropanol, isobutyl acetate, acetone and methyl ethyl ketone.

Before mixing the thinner and binder, elemental sulfur is added to the thinner. After the sulfur is added, excess undissolved sulfur, if any, is removed by filtering. Preferably, two or three parts of the thinner/sulfur solution are then mixed with one part of nitrocellulose to form the binder solution, depending on the desired viscosity for the binder solution.

The binder solution is then mixed with the coated zinc sulfide:manganese phosphor particles, preferably in the proportion of two milliliters of binder solution for each gram of coated particles. The amount of sulfur in the thinner is sufficient to provide from 0.1 to 3% and preferably 0.2% of sulfur by weight of the coated phosphor particles. If two parts of thinner/sulfur solution are mixed with one part of nitrocellulose, the preferred concentration of sulfur is provided by mixing 1.5 mg of sulfur per milliliter of thinner. If three parts of thinner/-sulfur solution are mixed with one part of nitrocellulose, the preferred concentration of sulfur is provided by mixing about 4 mg of sulfur per 3 milliliters of thinner.

The binder and coated phosphor are shaken with glass beads to form a homogeneous mixture. The mixture is strained to remove the glass beads and is sprayed on the substrate 11 over the anodes 14 and interlayer 9 to a thickness of from 15 to 40 microns, and preferably 25 microns. The thinner is thereafter evaporated to cause a coating of sulfur to form over the zinc sulfide particles that were previously coated with copper sulfide.

A layer of aluminum of about 1 to 2 microns is deposited by vapor deposition onto the dried layer of phosphor and binder. The aluminum at this thickness provides cathodes 17 that preferably have a resistivity of 0.1 ohm per square. The phosphor/binder layer and aluminum cathode layer are then scribed to form parallel rows of phosphor material with overlying cathodes, as shown in FIG. 1.

FIG. 1 illustrates the scribed phosphor rows 15 and associated scribed cathodes 17, as well as a continuous interlayer 9 to facilitate an understanding of the constituents of the panel. However, in practice, the scribing process will likely cut away portions of the aluminum oxide interlayer that lie under the removed portions of phosphor and aluminum. Accordingly, the interlayer will be scribed with the cathodes and phosphor and the anodes 14 will be left intact.

The panel cannot be used as an electroluminescent matrix display until it undergoes a forming process wherein energizing voltage and current are applied over time to render the phosphor elements of the display into a matrix of electroluminescent pixels. In the forming process, a temporary back cap (not shown), somewhat larger than the permanent cap 20 of FIG. 2, is disposed on the substrate 11 over the elements of a 640 column by 200 row panel and is held against the panel by clamps. The temporary back cap is sealed to the panel, for example by a sealing gasket disposed between the substrate and periphery of the cap. A dry inert or noble gas such as argon or helium at a temperature of between and 80° C. and 90° C. is then flushed through the chamber formed by the cap and substrate to displace the air therein, and eliminate nitrogen and water vapor.

After flushing the chamber of the cap, a voltage and current controlled source is electrically connected to the anodes and cathodes to begin forming the panel. In operation, the positive terminal of the source is connected to the anodes 14 and the negative terminal is connected to the cathodes 17, as shown schematically in FIG. 2.

Initial forming is achieved by initially applying a voltage of about 25 volts across the cathodes and anodes. The phosphor rows conduct current as a result of the copper coating on the powder phosphor grains in the binder. The interlayer breaks down at about 10 volts and therefore also conducts current. Initially, for several seconds, a maximum current of about 1 amp flows through the panel. This current causes the interlayer to quickly heat at its interface with the phosphor 15. This heating and the flow of current through the phosphor causes the powder phosphor grains in a thin layer adjacent to the interlayer interface to change state and form a solid, transparent luminous film. As the film forms, the resistance of the phosphor in the area increases and thereby decreases the current flowing through the phosphor and interlayer. After about three to four minutes, the luminous phosphor film has formed sufficiently to reduce the current of the panel to about 100 ma. At this point, the panel has initially formed to produce light at 25 volts.

In continuing forming, the applied voltage is increased over 25 volts and the current is monitored. As the voltage is initially increased, the current quickly and substantially increases. The voltage is increased until the current flowing in the panel results in a continuous power dissipation of no more than 1.25 watt/cm$^2$. In experimental forming of 640 by 200 panels, maintaining a continuous power dissipation of no more than about 20 watts has been found to produce panels with little degradation, if each panel is cooled during forming by a fan blowing ambient air. However, other upper limit values of power dissipation could be used. Also, the forming voltage could be pulsed to allow relatively higher momentary peak voltages and currents, without overheating and degrading the phosphor of the display.

When the product of the forming voltage and current is equal to the maximum allowed power, for example 20 watts, the voltage is maintained and the luminous film is further formed until the current of the panel drops sufficiently to allow the voltage to be increased again, without exceeding the defined maximum continuous power dissipation. Voltage is periodically increased until about 50 volts is applied, at which point initial forming is complete and the voltage is further increased in final forming in the described manner up to between 70 and 80 volts, or preferably about 70 volts, at which time a luminous transparent film about 1 micron thick is formed in the phosphor. At this point, the panel is finally formed to provide illumination at a voltage of about 70 volts.

Although the forming process requires heat which is preferably concentrated at the phosphor/interlayer interface, excessive heat can degrade the phosphor and result in decreased luminescence and reduced life for the panel, particularly when the panel is heated above the phase transition point (103° C.) of the copper sulfide of the phosphor.

It is known that the speed of forming may be increased by increasing the applied forming voltage. Theoretically, the forming voltage may be increased above levels discussed above and the time of forming may be reduced if the panel is cooled sufficiently, for example by refrigeration or water cooling, to avoid the degradation that results from excessive heating of the phosphor. Also, if materials other than aluminum oxide are used for the interlayer, the voltage/current relationship for forming will change. Moreover, a preferred thickness for such different materials could differ from the preferred thickness of 100 angstroms for aluminum oxide.

For example, it has been found in single row electroluminescent test panels that a magnesium oxide interlayer will require less than one-half the forming time and forming current required for forming with an aluminum oxide interlayer. A yttrium oxide interlayer will form in about the same time and with about 75% of the current required for an aluminum oxide interlayer. Data is not presently available for a magnesium fluoride interlayer, although it is known that advantageous reduced forming currents and forming times can be achieved with this material. An aluminum oxide interlayer is preferred due to the relative ease with which it can be formed in an electroluminescent panel. However, the process of the invention is not limited to an aluminum oxide interlayer or the values of forming current and voltage heretofore disclosed for such a layer.

After final forming, the temporary cap is removed from the substrate of the panel. The substrate may then be permanently sealed with the cap 20 of FIG. 2 in a vacuum or in an atmosphere of an inert or noble gas such as argon or helium. Alternatively, excess water may be removed from the panel before applying the cap 20. As indicated previously, water is undesirable because it tends to degrade the phosphor by further forming. Further forming is an undesirable continuation of the forming process over time, so that more voltage is required to produce a given illumination. Eventually, the energization voltage required to light the panel exceeds the voltage output of the driving circuit for the panel. At this point, the panel cannot be used.

In one such water removal process, a vacuum is applied to the panel and the panel is heated at about 90° C. for about 2 hours to drive off excess water and other volatile contaminants. The freshly degassed molecular sieve 21 is placed in the back cap and the unit is then sealed in a vacuum or in an inert or noble gas such as argon or helium.

Alternatively, after forming, the panel may be processed by freeze drying to remove excess water. In this water removal process, the temporary cap is removed and the panel is placed in a chamber (not shown) to which a vacuum is applied. An inert or noble gas such as argon or helium is then introduced and the temperature of the chamber is lowered to less than −10° C., preferably less than −30° C., to freeze the water in the panel into ice.

A partial vacuum is then applied to the chamber via a conduit to reduce the pressure of the chamber to less than 25 torr absolute pressure, and preferably to less than 12 torr absolute pressure. The vacuum causes the ice of the panel to sublime and to leave the panel and chamber through the vacuum conduit. The vacuum is maintained typically for about 20 to 60 minutes, until all ice is removed from the panel. Thereafter, a vacuum or an inert or noble gas such as argon or helium is introduced into the chamber and the back cap 20 is permanently sealed against the substrate with the freshly degassed sieve 21. The removal of water and the dry sealing of the elements of the panel will reduce or eliminate further forming and will therefore increase the operational life of the panel.

After the panel is sealed, the back cap 20 may be tested for leaks by submerging the sealed panel in warm water and watching for bubbles. Also, small leaks may be detected by placing the sealed panel in a vacuum chamber, applying a partial vacuum, and checking for the presence of inert gas leaking from the cap 20.

As a final step in manufacturing, the sealed panel is aged by cyclically and sequentially energizing the rows of the panel for one to two hours with 12 to 17 microsecond pulses at an operational voltage of about 120 volts and with a row current sufficient to apply a momentary current of about 0.5 ma to each pixel of a pulsed row. After aging, the panel should luminesce relatively uniformly under normal operating conditions.

In the described process, the phosphor 15 and cathodes 17 are scribed before forming. However, the scribing process may be facilitated by forming the matrix panel with the phosphor and aluminum cathode layers intact. As previously explained, the forming process results in formation of a solid luminous film at the phosphor/interlayer interface. If the cathodes and phosphor are scribed after the forming process, excess unformed powder phosphor and cathode material is removed, and the underlying interlayer and tin oxide anodes are protected by the solid luminous film. Accordingly, scribing can be accomplished with reduced risk of cutting through the relatively fragile tin oxide anodes.

FIG. 2 diagrammatically illustrates a power connection for an anode and cathode of the display. It should be understood that in manufacturing, these connections are made by removing a portion of the interlayer 9 from the ends of the cathodes and anodes and applying conducting bridging links to connect the row electrodes to row contact terminals and column electrodes to column contact terminals. Power is applied to these terminals by connectors (not shown).

It has been observed that there are four modes of failure of phosphor elements in electroluminescent matrix display panels. Each phosphor element in use is in effect a capacitor in parallel with a shunt resistance and in series with a series resistance. An increase of the voltage dropped across the luminous film is known as "further forming," i.e., progression of the forming process beyond that desirable to cause luminescence. A lowering of the resistance of the shunt resistor is known as "softening." A rising of the resistance of the series resistor is known as "flattening of the load line." The fourth mode of failure is a quantum mechanical degradation.

The flushing of nitrogen from the phosphor tends to reduce the incidence of softening by avoiding the formation of a conducting sulfur nitride ($SN_x$) polymer in the phosphor. The addition of silver as described further reduces or eliminates softening by combining with $SN_x$ in the phosphor and converting it to harmless $S_2N_2$ in the presence of heat or electrical energy. The silver also prevents flattening of the load line. The addition of sulfur as described helps prevent quantum mechanical degradation, by processes which would otherwise remove sulfur from the zinc sulfide (such as electrochemical decomposition, reaction of nitrogen to form nitrogen sulfides or oxidation to form sulfur dioxide or zinc oxide). Also, the sulfur tends to improve and maintain a desirable rise time of luminescence in relation to applied driving current. Removing water from the panel avoids or reduces further forming and degradation of the phosphor. Finally, the interlayer allows the panel to be quickly and uniformly formed at reduced power levels, thereby avoiding undesirable degradation of the phosphor and facilitating the manufacturing process.

Although particular preferred materials and manufacturing process steps have been described, it should be understood that the scope of the invention is not limited by this particular description. The metes and bounds of the invention are determined by the following claims and by the equivalents embodied therein.

We claim:

1. An electroluminescent display, comprising:

a substantially transparent nonconductive substrate means;

at least one substantially transparent conductive first electrode means disposed on said substrate means;

a substantially transparent insulative interlayer means disposed on said substrate means and said first electrode means;

powder phosphor means disposed over said interlayer means; and at least one conductive second electrode means disposed over said phosphor means;

said interlayer means having a uniform thickness for breaking down and passing a uniform current to uniformly heat an adjacent portion of said phosphor means in response to an electrical forming voltage applied between said first and second electrode means; and said phosphor means having means for forming a substantially transparent luminescent film in response to said electric forming voltage and the heating provided by said interlayer means.

2. The display of claim 1, wherein said interlayer means is a film having a thickness of 100 angstroms.

3. The display of claim 1, wherein said interlayer means is a film having a thickness of between 50 and 150 angstroms.

4. The display of claim 1, wherein said interlayer means is a substantially transparent metal oxide film.

5. The display of claim 1, wherein said interlayer means includes an insulating film having a breakdown voltage of between 6 and 15 volts.

6. The display of claim 1, wherein said interlayer means includes an insulating film having a breakdown voltage of about 10 volts.

7. The display of claim 1, wherein said interlayer means is a substantially transparent aluminum oxide film.

8. The display of claim 7, wherein said aluminum oxide has a thickness of 100 angstroms.

9. The display of claim 1, wherein said interlayer means is a film selected from the group consisting of aluminum oxide, magnesium oxide, magnesium fluoride, yttrium oxide, and zinc sulfide.

10. The display of claim 4, 5, 6, 7 or 9, wherein said film has a thickness of between 50 and 150 angstroms.

11. An electroluminescent matrix display, comprising:

a substantially transparent substrate;

a plurality of spaced parallel substantially transparent conducting anodes disposed on said substrate;

a plurality of spaced parallel conducting cathodes disposed over said anodes in perpendicular spaced relation to the anodes;

electroluminescent phosphor means disposed between said anodes and cathodes at crossover points of the anodes and cathodes, said phosphor means contacting said cathodes; and an insulative film disposed between and contacting said anodes and said phosphor means and having a uniform thickness and composition for facilitating forming of said electroluminescent phosphor means, said film selected from the group consisting of aluminum oxide, magnesium oxide, magnesium fluoride, yttrium oxide, and zinc sulfide.

12. The display of claim 11, wherein said film has a thickness of between 50 and 150 angstroms.

13. The display of claim 11, wherein said film is aluminum oxide and is about 100 angstroms thick.

14. The electroluminescent display of claim 1, formed by the process of:

disposing said at least one substantially transparent conducting first electrode on said substantially transparent substrate means;

forming said insulating interlayer means in contact with said at least one first electrode;

applying said phosphor means, including a dielectric binder and an electroluminescent phosphor over and in contact with said interlayer means;

disposing said at least one conducting second electrode over and in contact with said phosphor means;

applying said forming voltage across said first and second electrodes; and forming the phosphor means adjacent to said interlayer into said transparent luminescent film.

15. The process of claim 14, wherein said step of applying a forming voltage includes the step of controlling said voltage so that continuous power dissipated in said display is less than a preselected value.

16. The process of claim 15, wherein said preselected value is 1.25 watts per square centimeter of said phosphor means.

17. The process of claim 15, wherein said preselected value is 20 watts for a display having an aluminum oxide interlayer and about 640 first electrodes and about 200 second electrodes arranged in perpendicular relation to the first electrodes.

18. The process of claim 14, wherein said step of forming an interlayer includes the step of forming said interlayer means as an aluminum oxide film.

19. The process of claim 14, wherein said step of forming an interlayer includes the step of selecting the material of the interlayer means from the group consisting of aluminum oxide, magnesium oxide, magnesium fluoride, yttrium oxide and zinc sulfide and forming an insulating film from the selected material.

20. The process of claim 18 or 19, wherein said step of forming said film includes the step of forming said film to a thickness of between 50 and 150 angstroms.

21. The process of claim 18 or 19, wherein said step of forming said film includes the step of forming said film to a thickness of about 100 angstroms.

22. The process of claim 14, further including the steps of flushing said first and second electrodes, interlayer and phosphor means with an inert gas to remove at least nitrogen and water and forming the phosphor means in said inert gas.

23. The process of claim 22, wherein said inert gas is selected from the group consisting of argon and helium.

24. The process of claim 14, further including the step of making said electroluminescent phosphor from zinc sulfide:manganese particles coated with copper sulfide and silver.

25. The process of claim 24, further including the steps of flushing said first and second electrodes, interlayer and phosphor means with an inert gas to remove at least nitrogen and water and forming the phosphor means in said inert gas.

26. The process of claim 25, wherein said inert gas is selected from the group consisting of argon and helium.

27. The process of claim 24, further including the step of making said dielectric binder from nitrocellulose and elemental sulfur.

28. The process of claim 27, further including the steps of flushing said first and second electrodes, interlayer and phosphor means with an inert gas to remove at least nitrogen and water and forming the phosphor means in said inert gas.

29. The process of claim 28, wherein said inert gas is selected from the group consisting of argon and helium.

30. The process of claim 27, wherein said step of making the binder from nitrocellulose and elemental sulfur includes the step of providing said sulfur in the proportion of 0.1% to 3% by weight of said electroluminescent phosphor.

31. The process of claim 27, wherein said step of making the binder from nitrocellulose and elemental sulfur includes the step of providing said sulfur in the proportion of 0.2% by weight of said electroluminescent phosphor.

32. The process of claim 14, 22, 28, 30 or 31, further including the step of removing excess water from said formed phosphor means by heating the phosphor means in a vacuum and sealing said first and second electrodes, interlayer and formed phosphor means in vacuum or an inert gas.

33. The process of claim 22, wherein said inert gas is selected from the group consisting of argon and helium.

34. The process of claim 14, 22, 28, 30 or 31, further including the step of removing excess water from said formed phosphor means by heating the phosphor means in a vacuum and sealing said first and second electrodes, interlayer and formed phosphor means in vacuum or an inert gas.

35. The process of claim 34, wherein said inert gas is selected from the group consisting of argon and helium.

* * * * *

UNITED STATES PATENT AND TRADEMARK OFFICE

CERTIFICATE OF CORRECTION

PATENT NO. : 4,849,674

DATED : July 18, 1989

INVENTOR(S) : Walter L. Cherry et al.

It is certified that error appears in the above-identified patent and that said Letters Patent is hereby corrected as shown below:

In column 2, line 42, please delete "twostage" and substitute therefor --two-stage--.

In column 7, line 54, please delete "gains" and substitute therefor --grains--.

In column 7, line 60, after "sulfide" please insert --:--.

In column 8, line 67, please delete "and".

IN THE CLAIMS

In column 12 , line 52, after "oxide" please insert --film--.

Signed and Sealed this

Twenty-eighth Day of January, 1992

*Attest:*

HARRY F. MANBECK, JR.

*Attesting Officer*

*Commissioner of Patents and Trademarks*